United States Patent [19]

Weikel

[11] 4,145,837

[45] Mar. 27, 1979

[54] BALANCING BUBBLE BLOWING DEVICE

[76] Inventor: Gerald J. Weikel, 1105 Hawthorne Rd., Philadelphia, Pa. 19020

[21] Appl. No.: 796,180

[22] Filed: May 12, 1977

[51] Int. Cl.[2] ..... A63H 33/28

[52] U.S. Cl. ..... 46/6

[58] Field of Search ..... 46/6, 7, 13

[56] References Cited

U.S. PATENT DOCUMENTS

| | | | |
|---|---|---|---|
| 1,646,830 | 10/1927 | Mueller | 46/131 |
| 2,738,188 | 3/1956 | Hoffman | 46/131 |
| 3,665,637 | 5/1972 | Starr | 46/6 |

*Primary Examiner*—Louis G. Mancene
*Assistant Examiner*—Robert F. Cutting
*Attorney, Agent, or Firm*—Weiser, Stapler & Spivak

[57] ABSTRACT

A combination balancing bubble blowing device for use both in blowing bubbles and also as a balancing toy which comprises a bowl and the stem in combination with a bubble wand. The bubble wand is positioned in front of the bowl opening so that air from the bowl passes through the wand loop to form bubbles. The wand handle is so associated with the bubble pipe that the wand loop may be easily removed away therefrom for insertion into a bubble fluid container.

6 Claims, 7 Drawing Figures

BALANCING BUBBLE BLOWING DEVICE

BACKGROUND OF THE INVENTION

The present invention relates generally to the field of bubble blowing toys, and more particularly to a balancing bubble blowing pipe having a bubble wand movably associated therewith.

Various devices have been developed in the field of bubble blowing toys and most are either a bubble pipe or bubble wand of relatively conventional construction. The known types of bubble blowing pipes usually include a stem and an attached bowl which is upwardly open for blowing bubbles. The bowl chamber in such pipes is in communication with an air channel through the stem which terminates at the other end in a mouthpiece. By at least partially filling the bowl with a bubble fluid, such as a concentrated soap solution, and then blowing through the mouthpiece, it is possible to form bubbles at the surface of the bowl opening through the combined effects of the surface tension of the solution and the adherent contact of the solution with the perimeter of the bowl. This has long been known to be a toy which provides amusement to its user.

Bubble blowing devices have also been commonly employed in another embodiment, namely, a bubble wand, the usual bubble wand type of device consists essentially of a loop of rigid material having an elongated handle extending therefrom. Often the inner perimeter of the loop is serrated or otherwise altered in design to provide maximization of surface area in contact with the bubble fluid. The bubble wand has been employed in the production of bubbles by first dipping the loop into a bubble solution and then moving the want through the air to thereby effect bubble production in a manner somwhat different from that used in the bubble pipe described above.

In a field unrelated to bubble blowing toys of any description, workers have developed balanced supporting devices such as that disclosed in U.S. Pat. No. 2,738,188. This patent discloses a balanced supporting device including a block or rigid material provided with an angular recess therein. The recess is fabricated with a slightly curved wall extending from the top face of the block forwardly and downwardly and terminates at a relatively perpendicular shorter wall. A rubber foot contacts the shelf on which the balancing device is supported in a non-slipping manner. A belt positioned against the shorter wall and extending transversely along the curved face of the recess in combination with the angular inclination of the recess causes counteracting forces to be set up such a manner to support the outer end of the device in a substantially horizontal position cantilevered from the edge of the shelf from which it suspends. The inclined face of the recess causes the counterbalancing lower portion of the supported belt to extend upwardly of a perpendicular line drawn through the rubber foot to thereby result in a balanced support of the outer end portion of the block.

Heretofore, so far as applicant is aware, there has not been provided the combination of a balancing device with bubble blowing means. Further, there has not been disclosed bubble blowing means having a combination pipe and bubble wand portion in movable relation.

SUMMARY OF THE INVENTION

The present invention relates generally to a balancing bubble blowing device and more particularly to a combined bubble pipe and bubble wand which are so constructed as to balance from an extended ledge, when associated with an elongated, counterbalancing weight.

The bubble blowing device of the present invention comprises a pipe having a bowl portion and a stem portion, the bowl defining a chamber which communicates with an air passage through the stem portion. A bubble wand having a handle portion and a loop connects to the pipe in a manner to position the loop in front bowl chamber whereby air from the opening of the bowl chamber passes through the loop for bubble blowing purposes.

The handle portion of the bubble wand may be pivotally or otherwise movable mounted to the pipe at either the bowl or stem portion. In another embodiment, the pipe and wand may be a unitary body constructed of a single material such as molded plastic so as to be continuous with one another at a flexible joint, whereby the wand loop is movable away from the opening of the bowl chamber by flexing the wand handle. The bowl chamber may be of the same or different diameter as that air passage through the pipe stem.

The wand loop is movably associated with the bubble pipe so that the loop may be moved away therefrom for convenient introduction of the wand loop into the mouth of a bubble fluid container of conventional design.

In a preferred embodiment, the bubble blowing device of the present invention comprises a stem, neck, bowl and a balancing recess which is defined by the forward wall of the stem, the neck and the back wall of the bowl. The pipe is so constructed that the relationship of the stem, neck and bowl maintains a balanced position when cantilevered from an overhanging ledge with the mouthpiece in contact with the upper surface thereof. Additionally, this embodiment is effectively used in combination with an elongated, flexible counterbalancing weight to allow even greater flexibility in construction design of the bubble blowing device of the present invention.

It is therefore an object of the present invention to provide an improved bubble blowing device as described above.

It is another object of the present invention to provide a novel bubble blowing device having a bubble wand in movable relationship with a bubble pipe.

It is another object of the present invention to provide a novel balancing bubble blowing device which is designed to maintain a balanced position when cantilevered from an overhanging surface in combination with a counterbalancing weight.

It is another object of the present invention to provide a novel bubble blowing device having a bubble wand in movable relation to a bubble pipe whereby the loop of the bubble wand may be moved away from the pipe for insertion into a conventional bubble fluid container to load the wand prior to use.

It is another object of the present invention to provide a multi-purpose toy usable optionally as a suspending or animated balancing device or as a bubble blowing device of improved design.

It is another object of the present invention to provide a balancing bubble blowing device that is inexpensive in manufacture, simple in design and trouble free when in use.

Other objects and a fuller understanding of the invention will be had by referring to the following description and claims of a preferred embodiment thereof, taken in conjunction with the accompanying drawings, wherein like reference characters refer to similar parts through the several views and in which:

DESCRIPTION OF THE PREFERRED EMBODIMENT OF THE INVENTION

Figure 1:
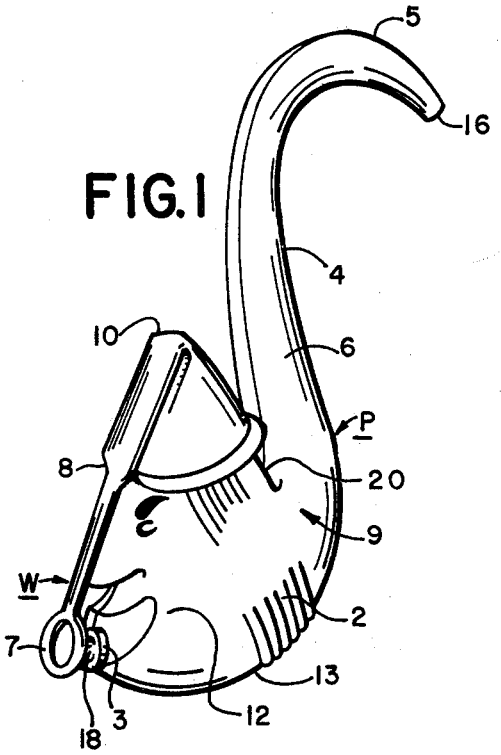
FIG. 1 is an isometric view of a preferred embodiment of the balancing bubble blowing device of the present invention.

Although specific terms are used in the following description for the sake of clarity, these terms are intended to refer only to the particular structure of the invention selected for illustration in the drawings, and are not intended to define or limit the scope of the invention.

As shown in the drawings, the balancing bubble blowing device generally designated as A of the present invention comprises a pipe, designated as P, having a bowl portion 2 and a stem portion 4, in association with a bubble wand, generally designated as W, having a handle portion 8 and a loop portion 7 positioned in association with the pipe P. The pipe P has an air passage 14 therethrough and the wand W is so positioned in relation to the pipe P, that air from the air passage 14 passes through a loop portion 7. The pipe P has a bowl portion or chamber 3 which is continuous with the air passage 14, and which may be of the same or other diameter. In the embodiment shown, the loop 7 is positioned to assure that air from the opening or outlet 18 of the bowl chamber 3 passes therethrough. Thus, by the directed force of the air passing through the loop portion 7, when a supply of bubble fluid has been created in the loop, bubble formation results.

The handle portion 8 of the bubble wand W can be movably mounted to the pipe P at either the bowl 2 or stem 4 portions. The end of the handle portion 8 is secured to the pipe P by attachment means 10, which may be any of a variety of embodiments. In a first embodiment, the attachment means 10 may be a plastic formed hinge whereby the loop 7 is movable away from the chamber opening 18 while still in lateral alignment therewith. Alternatively, the attachment means 10 may be designed to allow the lateral movement of the wand W so that the wand can move away from the chamber opening 18 and base portion 13 of the pipe P without extending substantially forwardly away from the point of attachment. In such an embodiment, the angle formed by the base portion and bubble wand W having its apex at the attachment means 10 does not substantially vary. In a third embodiment of the attachment means 10, the pipe P and the bubble wand W may be of unitary construction of a single material, such as molded plastic whereby the parts are continuous with one another at the flexible joint or attachment means 10. In such a construction, the wand loop 7 may be movable away from the opening 18 of the bowl chamber by flexure. In the embodiment of unitary construction, the pipe P and wand W preferably may be fabricated of any suitably durable material having a relatively firm but flexible consistency and having sufficient strength to withstand repeated flexure at the attachment means 10. Examples of suitable material include polypropylene and polyethylene plastics. The pipe P and the wand W may be formed by molding, machine cutting, or other conventional production processes as commonly employed for the materials selected for the purpose.

Figure 2:
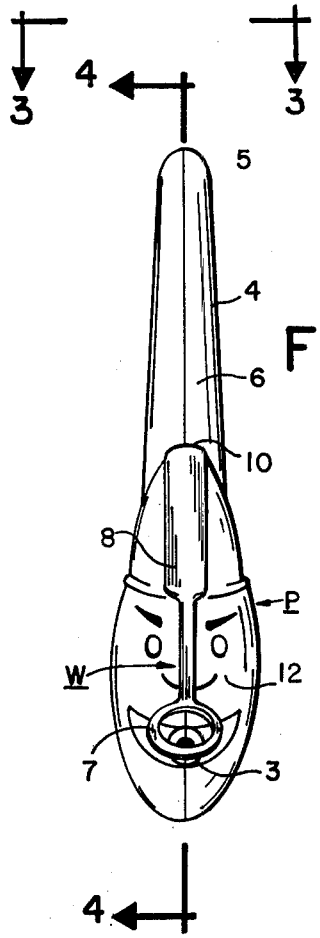
FIG. 2 is a front elevational view of the embodiment of FIG. 1.
Figure 3:
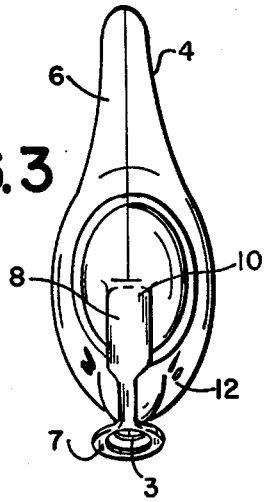
FIG. 3 is a top plan view of the balancing bubble blowing device, looking from line 3—3 of FIG. 2.

Referring now to FIGS. 2 and 3, the balancing bubble blowing device A comprises generally a stem 4 having a reflex portion 5 and main body portion 6, and a bowl 2 which is continuous with stem 4 at a point generally designated as a neck 9. A balancing recess 20 is formed near the neck 9 and is defined by the forward wall 24 of the stem 4, the neck formed end wall 22 and the rear wall 26 of the bowl 2. The device is so constructed as to maintain a balanced position when cantilevered from an overhanging ledge S by its stem (See FIG. 7).

This embodiment takes the form where the device can effectively be used in combination with a counterbalancing weight B.

FIGS. 2 and 3 further illustrate the embodiment of FIG. 1 and particularly show the attachment means 10 which can be unitary construction. Illustrated, as in FIG. 1, is a clown face configuration on the bowl portion 2 of the pipe P. Other ornamental configurations as may be desired in manufacture are obviously contemplated and are within the scope of the present disclosure.

Figure 4:
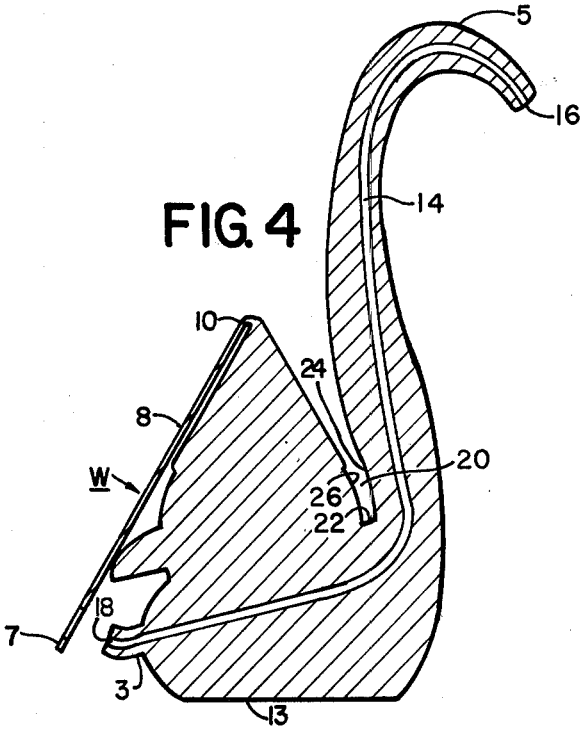
FIG. 4 is a cross sectional view taken along line 4—4 of FIG. 2, looking in the direction of the arrows.

The cross sectional view of FIG. 4 illustrates the air passage 14 of the stem portion 4 having an inlet opening at the mouthpiece 16 and an outlet opening at its opposite end at the chamber opening 18. A base 13 is illustrated upon which, the balancing bubble blowing device A can rest when not in use. The configuration of the balance recess 20 is illustrated in cross section and shows one sidewall 26 thereof formed by the bowl 2 and the other sidewall 24 defined by stem 4. The recess terminates at end wall 22 which is formed by the top of the neck 9. The operation of the recessed portion 20 in the use of balancing bubble blowing device A as a balancing toy will be described more fully hereinafter. It is to be noted that the loop portion 7 of the wand W is maintained in spaced relationship to the opening 18 by the configuration of the face 12 which is provided on the exterior of the bowl 2. By maintaining of this predetermined distance and alignment with the outlet opening 18, the forced air leaving the opening 18 is utilized to form bubbles in bubble fluid retained in and about the loop 7.

Figure 5:
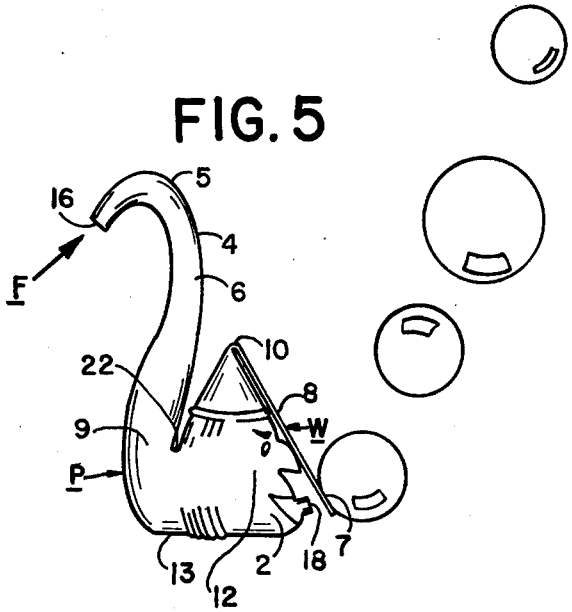
FIG. 5 is a side elevational view of the balancing bubble blowing device, on reduced scale, showing the device in use.
Figure 6:
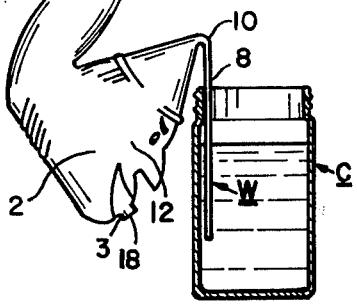
FIG. 6 is a partial view similar to FIG. 5, showing the loop moved away from the bowl for insertion into a bubble fluid container.

In FIGS. 5 and 6, the pipe P is illustrated in use as a bubble blowing toy. FIG. 5 illustrates the resultant bubble formation provided when forced air, designated by the arrow and the letter F, enters the mouthpiece 16 of the pipe P through use of any conventional manner, such as by blowing in the mouthpiece. When the forced air exits the chamber opening 18 of the opposite end of the continuous air passageway 14, the bubble fluid is agitated and distended to form spherical bubbles in the usual manner.

FIG. 6 illustrates hinged movement of the attachment means 10 in allowing the loop portion 7 of the wand W to be inserted into a conventional bubble fluid container C. It is contemplated that in this operation, as illustrated, the wand W will be moved sufficiently from the bowl 2 to permit the loop 7 to be inserted into the bottle or container C. The design of the container does not form a portion of this invention, but must be of such size that its opening will be of sufficient diameter to accommodate the loop 7.

Figure 7:
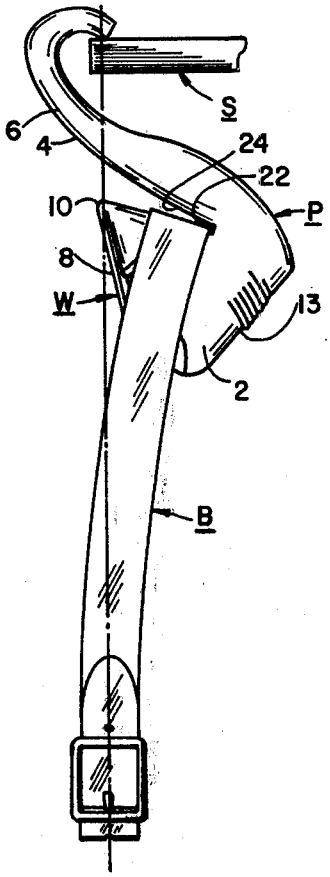
FIG. 7 is a side elevational view of the device balanced from a shelf and a counterbalanced by an elongated, flexible weight.

FIG. 7 illustrates the balancing toy aspect of the multi use balancing bubble blowing toy as it is extended from a horizontal surface in association with a counterbalancing weight B. The end of the bubble pipe stem 4 contacts the surface S and the pipe A balances rearwardly and downwardly as a result of the reflex design or configuration of the stem recess 20. The counterbalancing weight of elongated flexible construction, such as a belt or other slightly curved and flexible we, extends downwardly and rearwardly, along the vertical plane passing through the end contact upon the supporting surface. The curvature of the stem 4 around the end of the surface S on which it is cantilevered so positions the center of gravity of the combined apparatus in combination with the belt B to balance the entire system about the point of contact to thereby provide a self supporting freely standing, completely counterbalanced toy in the manner illustrated.

Although the invention has been described with a certain degree of particularity, it is understood that the present disclosure has been made only by way of example and that numerous changes in the details of construction and the combination and arrangement of parts may be resorted to wtihout departing from the scope of the invention. The scope of the invention should be limited only by the scope of the claims appended hereto.

What is claimed is:

1. A bubble blowing device which comprises a pipe having a bowl and a stem, each having a communicating air passage therethrough, said air passage having an inlet and an outlet; and a bubble wand, one end of which is pivotally mounted to the bowl of the pipe, and the other end of which having a loop positioned in spaced relation in front of the outlet;

whereby air from the air passage can pass through the loop to form bubbles.

2. The bubble blowing device of claim 1 wherein the pipe and wand are of unitary construction and contiguous with one another at a flexible joint.

3. The bubble blowing device of claim 1 wherein the loop of said wand is configured with at least one recess to retain excess bubble containing fluid.

4. The bubble blowing device of claim 1 wherein the stem comprises a reflex portion and a main body portion, the reflex portion and the bowl being joined by a neck therebetween, and a balancing recess defined by the forward side of the stem, the top of the neck and the rearward side of the bowl; the device being so constructed as to maintain a balanced position from a ledge when associated with a counterbalancing weight.

5. The bubble blowing device of claim 1 wherein the diameter of the inlet and the outlet are substantially equal.

6. The bubble blowing device of claim 1 wherein the air passage is serpentine in configuration.

* * * * *